US005090385A

United States Patent [19]

Usui et al.

[11] Patent Number: 5,090,385

[45] Date of Patent: Feb. 25, 1992

[54] FUEL DELIVERY RAIL ASSEMBLY

[75] Inventors: Masayoshi Usui, Numazu; Kazumi Fukaya, Mishima; Kazunori Takikawa, Numazu, all of Japan

[73] Assignee: Usui Kokusai Sangyo Kaisha Ltd., Shizuoka, Japan

[21] Appl. No.: 623,622

[22] Filed: Dec. 7, 1990

[30] Foreign Application Priority Data

Dec. 8, 1989 [JP] Japan ..... 1-317614

[51] Int. Cl.[5] ..... F02M 55/02

[52] U.S. Cl. ..... 123/468; 123/456; 123/470

[58] Field of Search ..... 123/468, 469, 470, 472, 123/456

[56] References Cited

U.S. PATENT DOCUMENTS

| | | | |
|---|---|---|---|
| 4,457,280 | 7/1984 | Hudson, Jr. | 123/470 |
| 4,474,160 | 10/1984 | Gartner | 123/468 |
| 4,519,368 | 5/1985 | Hudson, Jr. | 123/468 |
| 4,649,884 | 3/1987 | Tuckey | 123/470 |
| 4,660,524 | 4/1987 | Bertsch et al. | 123/468 |
| 4,751,904 | 6/1988 | Hudson, Jr. | 123/470 |
| 4,844,036 | 7/1989 | Bassler et al. | 123/468 |
| 4,971,014 | 11/1990 | Usui | 123/468 |
| 4,996,961 | 3/1991 | Usui | 123/470 |

FOREIGN PATENT DOCUMENTS

| | | | |
|---|---|---|---|
| 57-84362 | 5/1982 | Japan . | |
| 58-35266 | 3/1983 | Japan | 123/470 |
| 62-152073 | 9/1987 | Japan . | |

*Primary Examiner*—E. Rollins Cross
*Assistant Examiner*—Thomas N. Moulis
*Attorney, Agent, or Firm*—Wenderoth, Lind & Ponack

[57] ABSTRACT

A fuel delivery rail assembly is disclosed for supplying fuel to a plurality of fuel injectors in an engine. The assembly comprises a plurality of sockets and rail tubes. Each socket is divided into an upper portion and a lower portion. In one embodiment, each rail tube is also divided into an upper portion and a lower portion. All the socket upper portions and all the rail tube upper portions are combined into an elongated upper half unit, and all the socket lower portions and all the rail tube lower portions are combined into an elongated lower half unit. The upper half unit and the lower half unit are tightly connected byu a caulking deformation of one edge relative to another, with a seal member therebetween.

1 Claim, 3 Drawing Sheets

FUEL DELIVERY RAIL ASSEMBLY

BACKGROUND OF THE INVENTION

This invention relates to a fuel delivery rail assembly for an internal combustion engine, especially for an automotive engine, equipped with a fuel injection system. The fuel delivery rail assembly delivers pressurized fuel supplied from a fuel pump toward intake passages or chambers via associated fuel injectors. The assembly is used to simplify installation of the fuel injectors and the fuel supply passages on the engine.

There are two types of fuel delivery rail assemblies. One is a so-called top feed type and the other is a bottom flow type.

Japanese utility model public disclosure No. 152073/1987 discloses a typical design of the bottom flow type assembly, in which three tubular sockets are interconnected by connecting pipes. Each of the sockets is located at a predetermined distance from each other. These sockets are initially made through a forging process, and then directed to a precise machining operation. In this step, especially an interior surface of the socket should be smoothly, finished in order to establish a fluid tight seal with an O-ring. For this purpose, a special machining process utilizing burnishing work is commonly performed to effect a high grade of circumferential accuracy as well as surface smoothness.

Each socket comprises a tubular body having a top opening, a bottom opening and two lateral openings facing opposite directions. These lateral openings are used to receive distal ends of the connecting pipes. By means of brazing connections, the sockets and the pipes are fixed together.

Since the conventional fuel delivery rail assembly is constructed as stated above, many manufacturing steps are required for assembly. In particular, the brazing connections give rise to manufacturing difficulties. During a brazing operation, thermal distortion cannot be perfectly eliminated. As a result, there remain several drawbacks, such as fuel leakage and breakdown from the parting lines.

In U.S. Pat. No. 4,457,280 (Hudson), there is disclosed a top feed type assembly, in which the beam portion of the rail is split into two units, an upper portion and a lower portion. The sockets are brazed to one of the units. The units are combined together in a brazing operation. However, in this design, there is a disadvantage that the assembly tends to be bent or curved due to a thermal distortion caused by the brazing. The metallic material suffers from degradation and breakdown.

In Japanese utility model public disclosure No. 84362/1982, there is disclosed a die casting type assembly in which the sockets and the conduit are integrally formed through a die casting process. However, there are many problems such as inferiority of plating, increase and weight, or inside defects which are not visible from outside.

SUMMARY OF THE INVENTION

It is an object of the present invention to eliminate or reduce the welding steps in producing the fuel delivery rail assembly and to prevent thermal distortion and degradation of the metallic material of the assembly.

Another object of the present invention is to eliminate fuel leakage from the fuel delivery rail assembly.

According to one aspect of the invention, there is provided a fuel delivery rail assembly for an internal combustion engine, comprising a plurality of sockets adapted to receive associated fuel injectors, and a plurality of rail tubes extending from the sockets for arranging them in predetermined intervals, each of the sockets being divided into a socket upper portion and a socket lower portion, and each of the rail tubes being divided into a tube upper portion and a tube lower portion. All of the socket upper portion and all of the tube upper portion are combined into an elongated upper half unit, and all of the socket lower portion and all of the tube lower portion are combined into an elongated lower half unit. The upper half unit and the lower half unit are tightly connected by a caulking deformation of one parting edge relative to another with a seal member disposed therebetween.

Within the scope of the invention, the upper unit and the lower unit are connected by a caulking operation without need of welding or brazing, so that thermal distortion and degradation of the metallic material are effectively eliminated. Between the upper unit and the lower unit is disposed a seal member, so that liquid-tightness is maintained to avoid fuel leakage.

The upper and lower units can be made through a pressing operation from metallic material, or by injection moulding of plastic material. The seal member is selected from various materials suitable for the place, and can be formed into an O-ring, gasket, packing or the like.

As long as the sealing properties are maintained, the upper unit and the lower unit can be made from different materials. Accordingly, many kinds of requirements such as reduction of weight, characteristics of heat transfer, vibration damping, and or surface finishing can be satisfied by suitably selecting the materials of the units.

According to another aspect of the invention, there is provided a fuel delivery rail assembly comprising a plurality of sockets and rail tubes, each of the sockets being divided into a socket upper portion and a socket lower portion, and all of the socket lower portion or all of the socket upper portion being combined with the rail tubes, thereby forming an elongated main unit. Each socket upper portion and each socket lower portion are tightly connected by a caulking deformation of one parting edge relative to another with a seal member disposed therebetween.

In this embodiment, the construction of the assembly is considerably simplified, since the rail tubes are combined in one unit. Each socket is formed of a combination of the upper portion and the lower portion by a caulking deformation, so that there is no need for welding or brazing. Fuel leakage is effectively avoided by utilizing the seal member.

Other features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
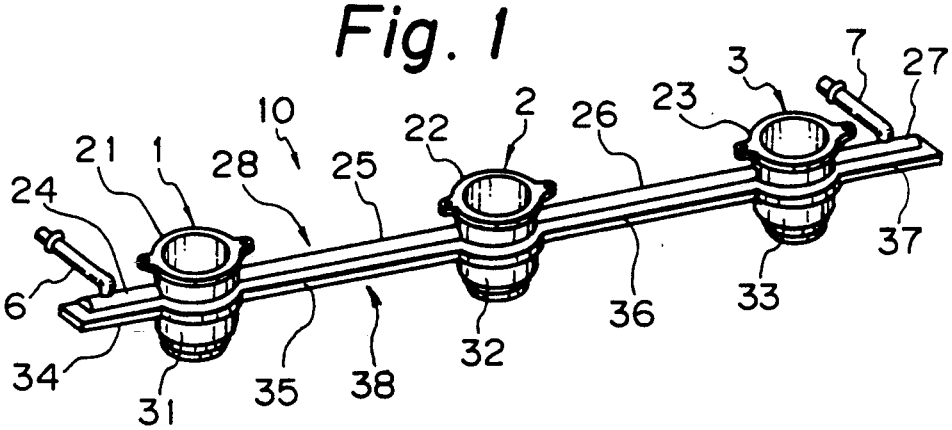
FIG. 1 is a perspective view of the fuel delivery rail assembly according to the invention.

Referring to FIG. 1, there is shown a fuel delivery rail assembly 10, a first embodiment of the present invention, which is adapted to use with three cylinders on one side of an automotive V-6 engine. This assembly 10 comprises three tubular sockets 1, 2, 3 made of metallic material, and rail tubes interconnecting the sockets. The sockets 1, 2, 3 are divided into upper portions 21, 22, 23 and lower portions 31, 32, 33, respectively. Rail tube sections extending from the sockets are also divided into upper portions 24, 25, 26, 27 and lower portions 34, 35, 36, 37, respectively. The socket upper portions and the tube upper portions are combined into an upper half unit 28, and on the other hand, the socket lower portions and the tube lower portions are combined into a lower half unit 38. These units are made in a pressing operation from steel material, by injection moulding plastic, or by aluminum die casting. To both ends of the upper half unit 28 are attached branch pipes 6 and 7 for receiving connecting hoses.

Figure 2:
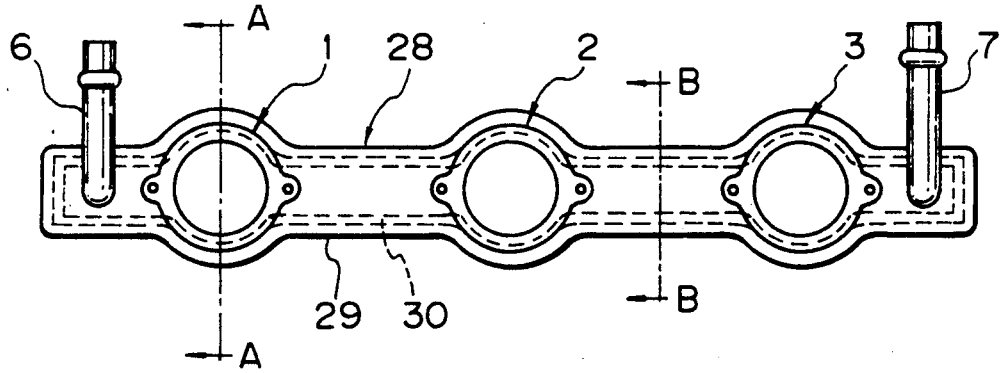
FIG. 2 is a plan view of FIG. 1.
Figure 3:
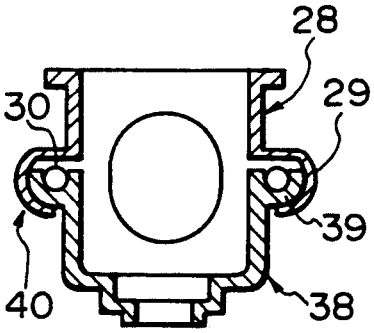
FIG. 3 is a vertical sectional view taken along the line A—A in FIG. 2.

In FIG. 3, a connecting method utilizing a caulking deformation (or crimping) is illustrated. The bottom edge of the upper half unit 28 is transformed into an outwardly projecting semicircle 29. On the other hand, the top edge of the lower half unit 38 is transformed into an upwardly opening U-type groove 39. First, a packing 30 is inserted into the groove 39. Then, the upper half unit 28 is put over the lower half unit 38, and the semicircle 29 is mechanically shrunk by a caulking tool. Thus, the upper half unit 28 and the lower half unit 38 are tightly connected by a caulking deformation 40 around the groove 39. The packing 30 is formed into an endless shape extending along the periphery of the assembly 10, as shown by dotted line in FIG. 2.

Figure 4:
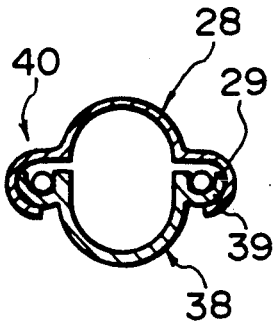
FIG. 4 is a vertical sectional view taken along the line B—B in FIG. 2.

FIG. 4 shows a section of the rail tubes formed by the half units 28 and 38. The section of each unit is formed in a semicircular shape, and after the upper and lower units are combined, they can provide a substantially circular section.

Figure 5:
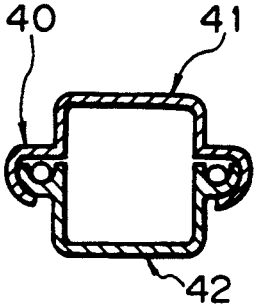
FIG. 5 is a vertical sectional view showing a modification from FIG. 4.

FIG. 5 shows a modified section of the rail tubes. Both sections of the upper unit 41 and the lower unit 42 are formed in channel shapes, and after they are connected, they can form a substantially rectangular section.

Figure 6:
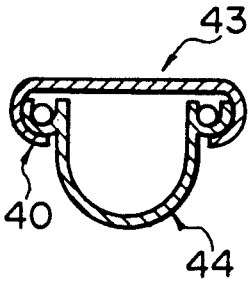
FIG. 6 is a vertical sectional view showing another modification from FIG. 4.
Figure 7:
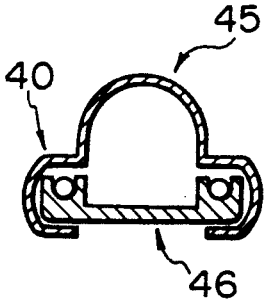
FIG. 7 is a vertical sectional view showing a further modification from FIG. 4.

FIGS. 6 and 7 show further modified sections. In FIG. 6, the upper half unit 43 is formed in a flat shape, and the lower half unit 44 is formed in a semicircular shape. In FIG. 7, the upper half unit 45 is formed in a semicircular shape, and the lower half unit 46 is formed in a flat shape. These sectional forms can be variously modified in order that the most appropriate configuration for the engine is obtained.

Figure 8:
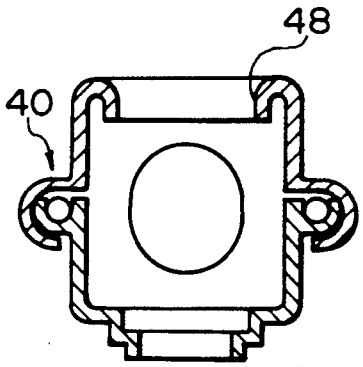
FIG. 8 is a vertical sectional view showing a modification from FIG. 3.

FIG. 8 shows a modified section of the socket, in FIG. 3. The top edge of the socket is folded inwardly to form an inside sealing flap 48, which is suitable for receiving an O-ring carried around the associated fuel injector.

Figure 9:
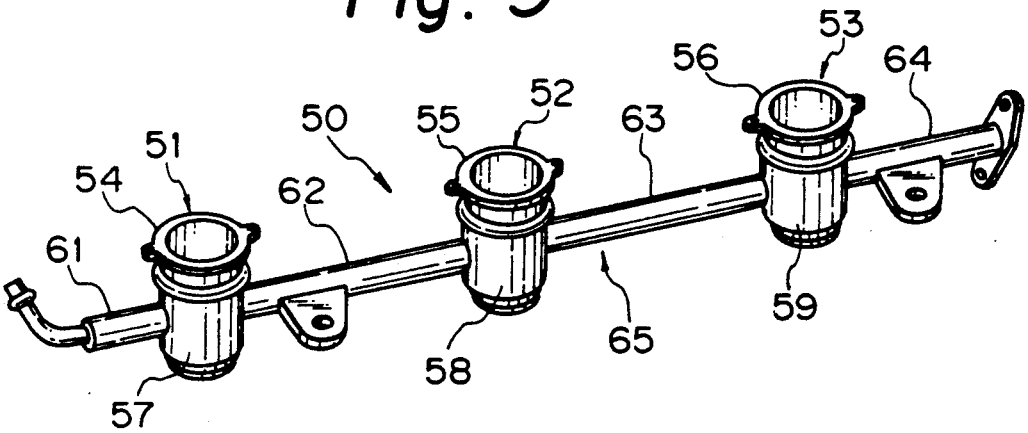
FIG. 9 is a perspective view of the fuel delivery rail assembly according to a second embodiment of the invention.

FIG. 9 shows a second embodiment of the invention. In this fuel delivery rail assembly 50, three tubular sockets 51, 52, 53 are divided into socket upper portions 54, 55, 56 and socket lower portions 57, 58, 59, respectively. Different from the first embodiment, all of the upper portions 54, 55, 56 are separate from the rail tubes 61, 62, 63, 64, which, together with the socket lower portions 57, 58, 59, define an elongated main unit 65. The main unit 65 can be made from steel material, plastic or aluminum through the aforementioned manufacturing process.

Figure 10:
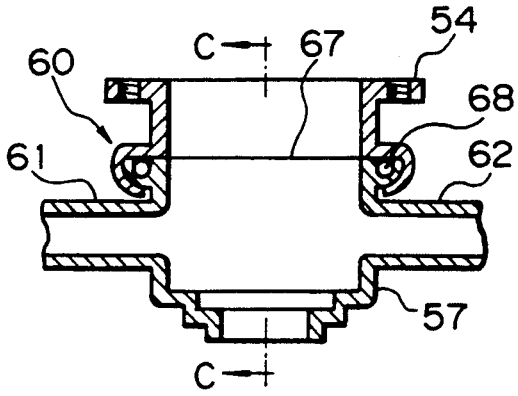
FIG. 10 is a vertical sectional view of the socket taken along the longitudinal line of the assembly of FIG. 9.
Figure 11:
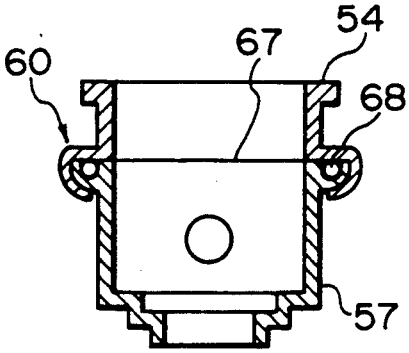
FIG. 11 is a vertical sectional view taken along the line C—C in FIG. 10.

The connection between the socket upper portion and the socket lower portion is illustrated in FIGS. 10 and 11. After the O-ring 68 is inserted into the upwardly opening U-type groove of the socket lower portion 57, the socket upper portion 54 is put over the lower portion 57 along the parting line 67. Then, by utilizing a caulking tool, the caulking deformation 60 is formed, so that the socket upper and lower portions are tightly connected.

Figure 12:
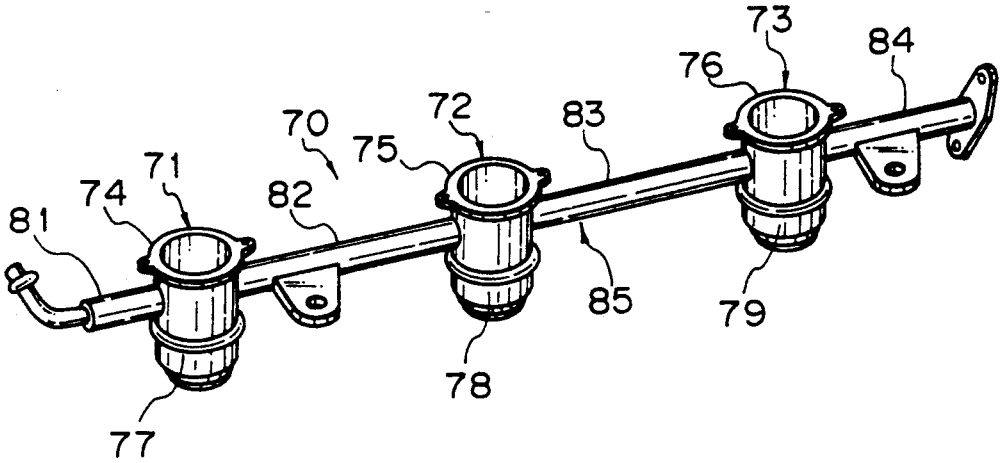
FIG. 12 is a perspective view of the fuel delivery rail assembly according to a third embodiment of the invention.

FIG. 12 shows a third embodiment of the invention. In this fuel delivery rail assembly 70, three tubular sockets 71, 72, 73 are divided into socket upper portions 74, 75, 76 and socket lower portions 77, 78, 79, respectively. Different from the second embodiment, all of the lower portions 77, 78, 79 are separate from the rail tubes 81, 82, 83, 84, which, together with the socket upper portions 74, 75, 76 define an elongated main unit 85. The main unit 85 can be made from steel material, plastic or aluminum through the aforementioned manufacturing process.

Figure 13:
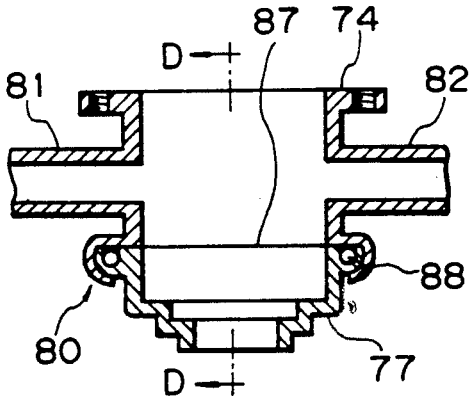
FIG. 13 is a vertical sectional view of the socket taken along the longitudinal line of the assembly of FIG. 12.
Figure 14:
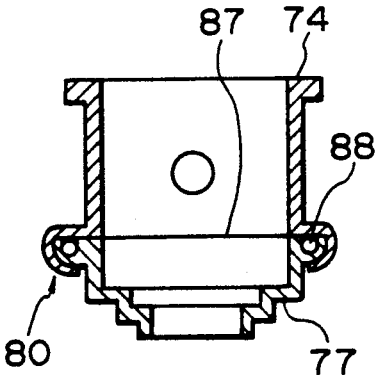
FIG. 14 is a vertical sectional view taken along the line D—D in FIG. 13.

The connecting relationship between the socket upper portion and the socket lower portion is illustrated in FIGS. 13 and 14. After the O-ring 88 is inserted into the upwardly opening U-type groove of the socket lower portion 77, the socket upper portion 74 is put over the lower portion 77 along the parting line 87. Then, by utilizing a caulking tool, the caulking deformation 80 is formed, so that the socket upper and lower portions are tightly connected.

According to the second and third embodiments, the construction of the fuel delivery rail assembly is considerably simplified, since the number of combined unit is only one.

I claim:

1. A fuel delivery rail assembly for an internal combustion engine, comprising:

a plurality of sockets adapted to receive associated fuel injectors;

a plurality of rail tube sections extending from said sockets for arranging said sockets at predetermined intervals;

each of said sockets being divided into a socket upper portion and a socket lower portion;

each of said rail tube sections being divided into a tube upper portion and a tube lower portion;

all of said socket upper portions and all of said tube upper portions being combined into an elongated upper half unit;

all of said socket lower portions and all of said tube lower portions being combined into an elongated lower half unit; and said upper half unit and said lower half unit being tightly connected by having an edge of one of said upper and lower half units crimped about an edge of the other of said upper and lower half units, with a seal member interposed therebetween.

* * * * *